US005307537A

United States Patent [19]

Essex et al.

[11] Patent Number: 5,307,537

[45] Date of Patent: May 3, 1994

[54] CONVERTER FOR A VACUUM CLEANER NOZZLE

[75] Inventors: John D. Essex, North Canton; Ronald J. Stephens, Rittman, both of Ohio

[73] Assignee: The Hoover Company, North Canton, Ohio

[21] Appl. No.: 980,334

[22] Filed: Nov. 23, 1992

[51] Int. Cl.[5] ..... A47Z 5/30

[52] U.S. Cl. ..... 15/323; 15/338

[58] Field of Search ..... 15/323, 338; 211/60.1; 248/176, 309.2

[56] References Cited

U.S. PATENT DOCUMENTS

| | | | |
|---|---|---|---|
| 2,310,268 | 2/1943 | Taylor | 15/338 |
| 2,871,504 | 2/1959 | Gall | 15/338 |
| 2,935,760 | 5/1960 | Martinez | 15/323 |
| 3,294,352 | 12/1966 | Leonard | 248/309.2 |
| 3,955,237 | 5/1976 | Chateauneuf | 15/338 |
| 4,357,177 | 11/1982 | Knox | 15/338 |
| 4,653,638 | 3/1987 | Lackner | 15/323 |
| 4,695,022 | 9/1987 | Mendosa | 248/176 |
| 4,700,428 | 10/1987 | Hetherington | 15/338 |
| 5,092,015 | 3/1992 | Kosten | 15/338 |

FOREIGN PATENT DOCUMENTS

| | | | |
|---|---|---|---|
| 1121870 | 8/1956 | France | 248/309.2 |
| 431014 | 6/1935 | United Kingdom | 15/323 |
| 519664 | 4/1940 | United Kingdom | 15/338 |

*Primary Examiner*—Philip R. Coe
*Assistant Examiner*—Terrence R. Till

[57] ABSTRACT

The present invention teaches a converter whereby a power driven agitator brush type vacuum cleaner such as a hand held cleaner, may be converted for use with an extended vacuum hose and associated suction tools. The converter incorporates a tool caddy having storage posts upon which the suction tools may be stored both during use of the cleaner in the converted mode or when the converter is not in use.

16 Claims, 4 Drawing Sheets

CONVERTER FOR A VACUUM CLEANER NOZZLE

BACKGROUND OF THE INVENTION

The present invention generally relates to a floor type vacuum cleaner having a powered brush, such as a hand held cleaner, and more particularly to a converter attachment whereby the cleaner may be converted for use with a suction hose and/or associated cleaning tools.

Suction hose converters for hand held vacuum cleaners, having a powered agitator brush, have become popular for converting such cleaners for use with traditional suction cleaning accessories such as a dusting brush, crevice tool, extension hose, and the like. Heretofore such converters have not included provisions for the convenient storage of the associated accessories for easy access while cleaning.

Prior art converter packages, for hand held powered brush vacuum cleaners, generally include wall storage means for the cleaner and its associated accessories. However when using the cleaner the user must necessarily carry the necessary accessories along in hand, pocket or otherwise.

Accordingly it is an object of our invention to provide a convenient caddy means, as an integral part of the converter, whereby the associated suction tools may not only be easily stored when not in use but may be carried along with the cleaner when the converter is in use.

Another object of the invention is to provide a converter arrangement whereby the accessory tools are stored in an unobtrusive manner such that they do not interfere with the necessary operation and hose manipulation during the cleaning operation.

It is a further object of our invention to provide an improved engagement and disengagement mechanism for attaching the converter to the vacuum cleaner.

These and other objects of the present invention will become apparent to those skilled in the art as the description thereof proceeds.

SUMMARY OF THE INVENTION

The present invention provides a converter whereby a floor type vacuum cleaner may be conveniently converted to an above the floor cleaner wherein the converter embodies convenient vacuum tool accessory storage means. The preferred embodiment of our converter comprises a main body forming a plenum chamber fluidly communicating with the vacuum cleaner inlet nozzle and having a forwardly extending connector for receiving thereon a vacuum hose or other typical vacuum accessory tools. Extending rearwardly from the converter main body are accessory tool storage posts for receipt and storage thereon of desired vacuum accessories. Such accessory storage posts preferably comprise two perpendicularly intersecting blades for frictionally receiving thereon the desired vacuum accessories. The converter including an attached vacuum hose and having vacuum tool accessories upon the storage posts may, as an assembly, be conveniently removed from the vacuum cleaner and stored upon a convenient wall rack or the like thereby providing convenient storage of the converter with the vacuum tool accessories thereon during non-use.

DESCRIPTION OF THE PREFERRED EMBODIMENT

Figure 1:
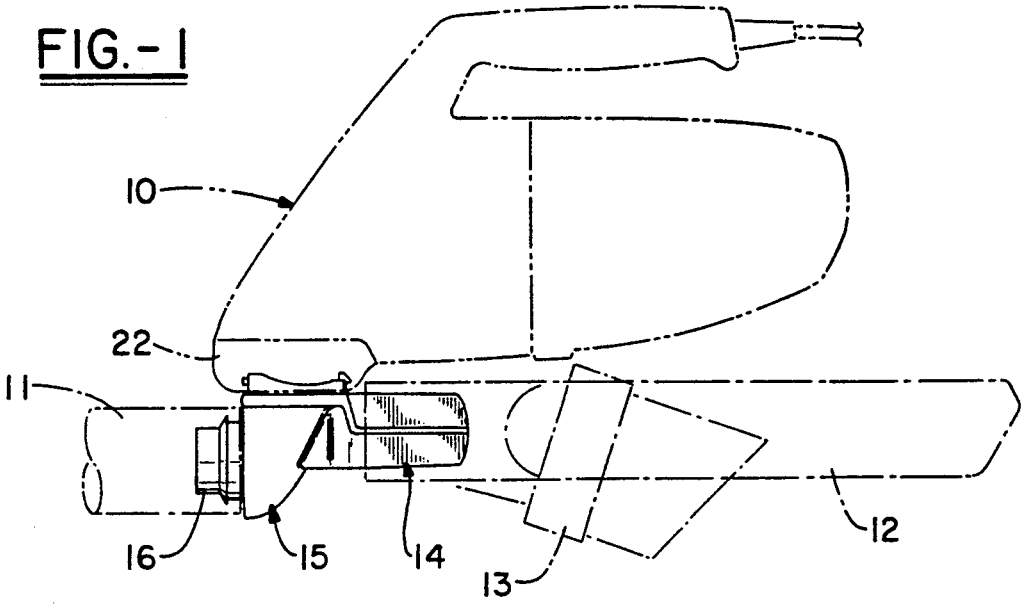
FIG. 1 is a side elevational view of our converter showing a hand held powered brush type vacuum cleaner, suction hose and attached cleaning tools in broken lines as background environment.

Referring to FIG. 1 a typical hand held, powered brush, vacuum cleaner 10 is shown (in broken lines) having our new and improved suction converter 15 attached to the inlet suction nozzle 22 thereof. Extending forward from converter 15 is suction inlet 16 having attached thereto a flexible suction hose 11 (shown in broken lines) which may be, for example three or four feet in length and to which traditional cleaning tools are generally attached.

Although it is preferred that hose 11 be permanently attached to inlet nozzle 16, inlet nozzle 16 may be configured so as to permit removal of hose 11 thereby permitting attachment of the accessory cleaning tools directly thereto for use without hose 11. Generally extending rearward from converter 15 are one or more post assemblies 14 upon which cleaning tool accessories, such as a crevice tool 12 and/or dusting brush 13 (both shown with broken lines), may be conveniently carried and/or stored. Such accessories are typically provided with tubular converters for frictional engagement with the tubular hose end or storage posts 14.

Figure 2:
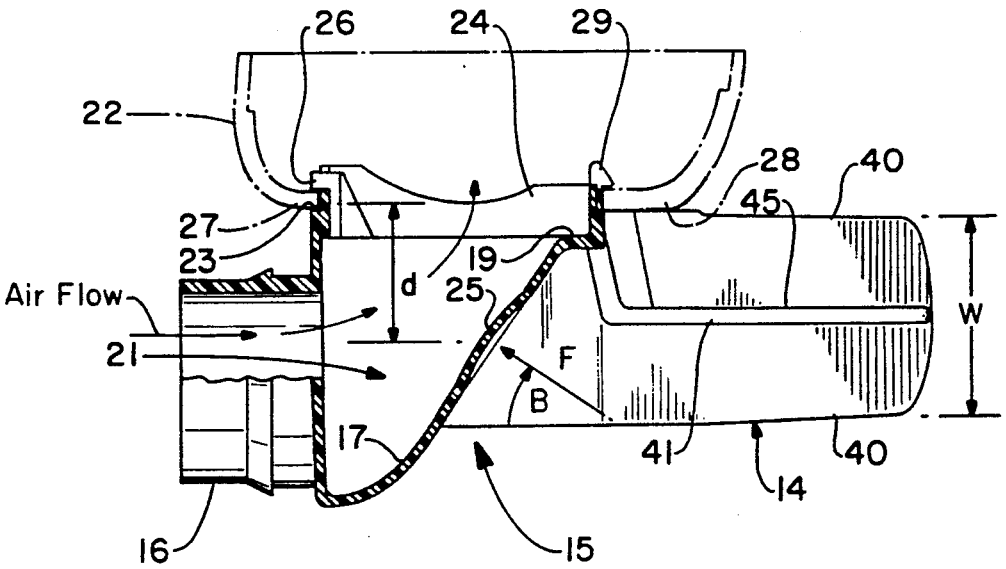
FIG. 2 is a cross sectional view taken along the center line 2—2 of FIG. 3.
Figure 6:
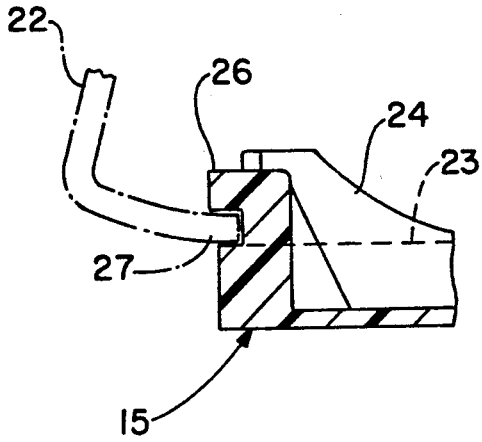
FIG. 6 is a partial cross sectional view taken along line 6—6 of FIG. 3.
Figure 7:
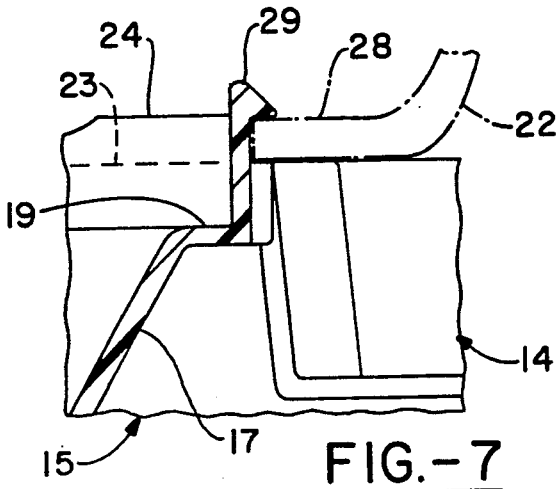
FIG. 7 is a partial cross sectional view taken along the center line 7—7 of FIG. 3.
Figure 3:
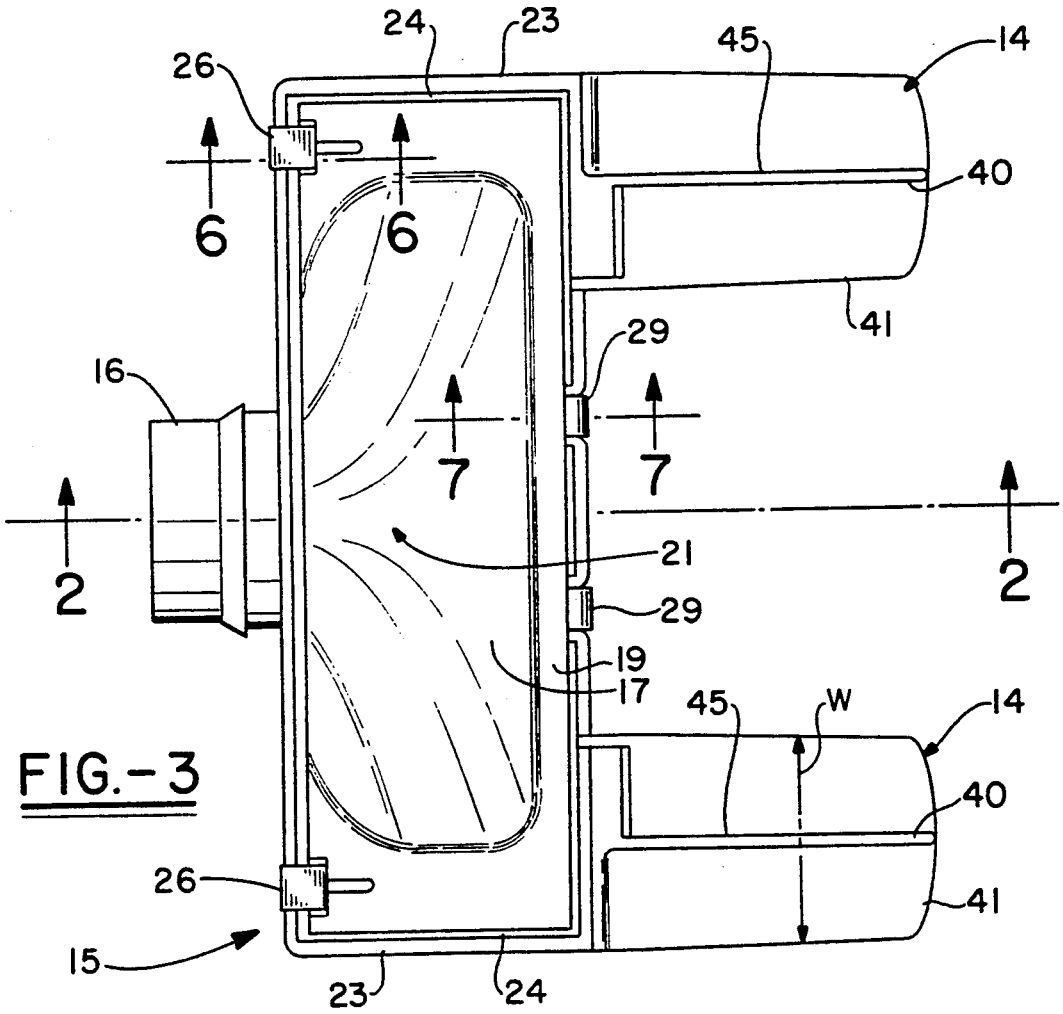
FIG. 3 is a top plan view of our converter.
Figure 4:
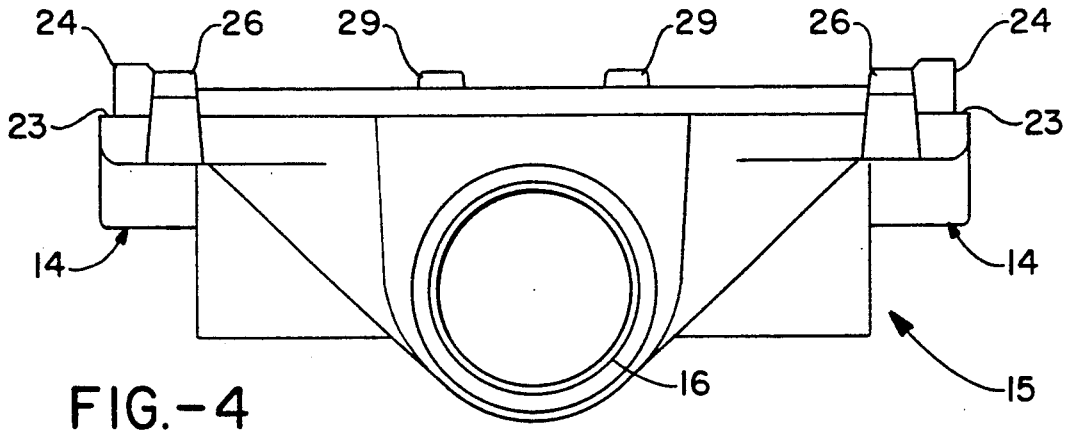
FIG. 4 is a front elevational view of our converter.

Referring now to FIGS. 1 through 8. Converter 15 typically defines a plenum chamber 21 in fluid communication with the suction nozzle 22 of vacuum cleaner 10. Surrounding the plenum chamber 21, so as to make an air tight fit with the vacuum cleaner's suction nozzle 22, is an annular lip 23 continuing around the perimeter of converter 15 as best seen in FIG. 3. Lip 23 includes wall 24 which projects partially into and is in registry with the cleaner's inlet suction nozzle 22. The converter 15 is typically retained within nozzle 22 by interlocking tabs 26 which overlappingly interlock with the forward lip 27 of nozzle 22 as shown in FIGS. 2, 3 and 6. Interlocking with the rear lip 28 of nozzle 22 are two resilient, snap fit, tangs 29 as shown in FIGS. 2, 3, and 7.

Vacuum cleaner 10 is equipped with a motor fan assembly (not shown) by which a vacuum is created within nozzle 22 thereby creating an airflow through hose 11 and inlet 16, into and through plenum 21 to the cleaner nozzle 11 as indicated by the flow arrows as shown in FIG. 2.

Figure 5:
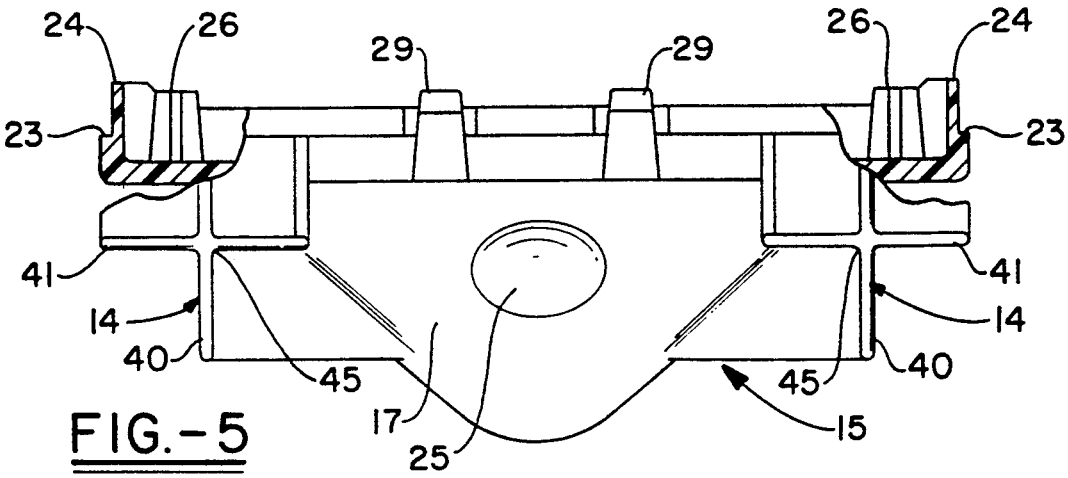
FIG. 5 is a rear elevational view of our converter.
Figure 8:
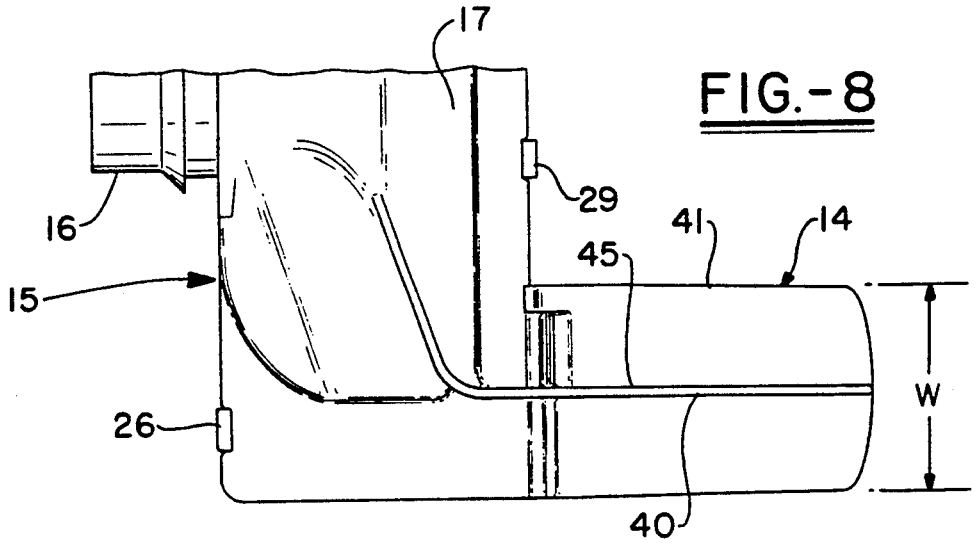
FIG. 8 is a half bottom view of our converter.

Converter 15 is attached to nozzle 22 by first engaging tabs 26 with the forward lip 27 of nozzle 15 and rotating the converter, counterclockwise, as viewed in FIG. 2, into position thereby snapping tangs 29 into locking engagement with the rear lip 28 of nozzle 22. For removal of converter 15 from nozzle 22 the rear wall 17 of plenum chamber 21 is provided with a "push" recess 25 preferably coincident with the centroid of the triangularly shaped rear wall 17 (FIG. 5). The rear wall 17 thickness and the plenum lip edge 19 are configured such that application of force vector F (FIG. 2) upon the "push" recess 25 causes lip edge 19 and tangs 29 to deflect inward thus releasing tangs 29 from locking engagement with rear nozzle lip 28 thereby providing easy removal of converter 15 from vacuum cleaner 10. Simultaneously with the deflection of tangs 29, application of force F upon "push" recess 25 creates a clockwise moment ($d \times F \cos B$) about the forward lip 27 of nozzle 22 thereby assisting the removal of converter 15 from cleaner 10.

Converter 15 is preferably made of ABS plastic material and engineered to provide the necessary structural rigidity but nevertheless exhibit sufficient flexibility to permit sufficient deflection of tangs 29 for attachment and removal.

Extending rearward from the body of converter 15 is at least one accessory mounting post 14, preferably two, for receiving thereon associated suction tool accessories such as a dusting brush 13 and/or a crevice tool 12 shown with broken lines.

Post 14 preferably comprises two planer blades 40, 41, one generally extending vertical 40 and the other horizontal 41, preferably intersecting at their common mid-point 45 (FIG. 5). Blades 40 and 41 are of such a dimensional width and height W so as to receive thereon, in a friction fit engagement, the inside diameter of the accessory suction tool's tubular converter.

Although a post comprising two intersecting blades, as shown in the Figures is preferred, it is to be understood that any number of blades, greater than or less than two, may also be employed. For example a single blade may be employed as may three or four.

Alternatively one may consider post 14, as shown in the drawings, as comprising four blades meeting at a common intersection 45. In this regard the post may also comprise an odd number of blades such as three or five. Although preferred, it is not necessary that the blades comprising post 14 be symmetrical about the axial centerline (Intersection 45). It is considered within the scope of our invention that post 14 may take the form of any number of configurations such as shown, by way of example, in FIGS. 9A, through 9D. It is understood that the configurations as illustrated in FIGS. 9A through 9D are for illustrative purposes only and not intended to limit the number of possible geometric configurations.

Further the structure of storage posts 14 need not be limited to flat planner blades. It is also conceivable that the flat blade structure may be replaced with curved surfaces or combinations of planer blades and curved surfaces as shown in FIGS. 9A and 9C.

Figure 9A:
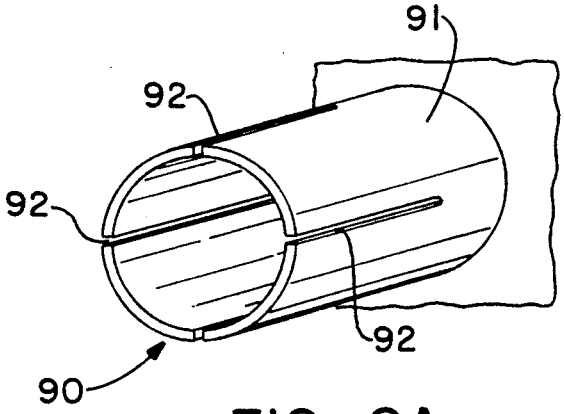
FIGS. 9A through 9D presents alternative configurations for the suction tool storage posts.

For purposes of illustration and not limitation, FIGS. 9A through 9D teach alternate embodiments of accessory support posts. FIG. 9A presents an accessory storage post 90 having a cylindrical section 91 preferably including but not necessarily required, slots 92 to permit radial divergence or convergence for frictionally receiving the tubular converter of a vacuum tool accessory telescopingly therein or circumscribingly thereon.

Figure 9B:
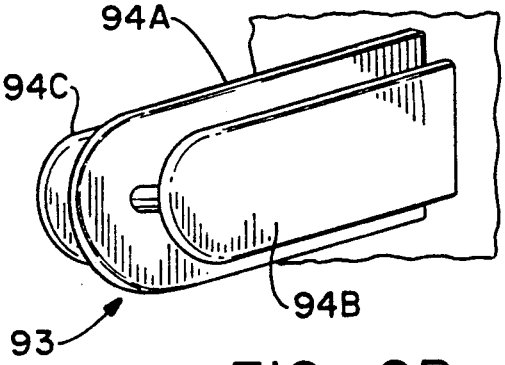

FIG. 9B illustrates an accessory storage post 93 having parallel blades 94A, 94B and 94C. Post 93 is intended to telescopingly and frictionally engage the inside diameter of an accessory tubular converter with blade 94A diametrically bisecting the inside of the accessory's tubular converter and blades 94B and 94C forming a chord with the inside cylindrical surface of the tubular converter.

Figure 9C:
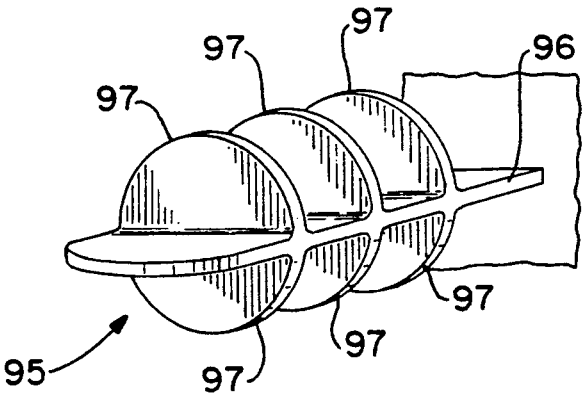

FIG. 9C illustrates a tool storage post 95 generally comprising a blade 96 having transverse semicircular discs 97 projecting therefrom. Post 95 is configured so as to telescopingly and frictionally receive the tubular converter of a vacuum tool accessory thereon.

Figure 9D:
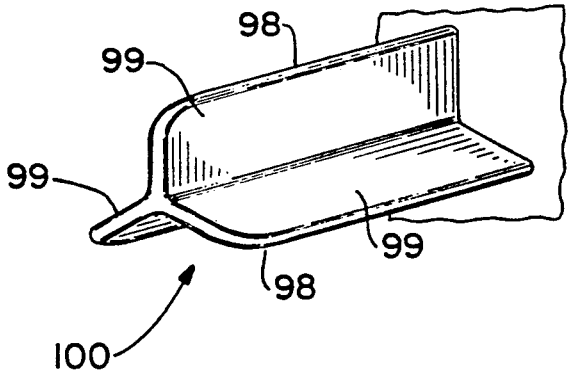

FIG. 9D depicts a tool storage post 100 having three equally spaced intersecting blades 99. The longitudinal edge 98 of each blade is adapted to frictionally engage the inside diameter of a vacuum tool accessory tubular converter.

Although not shown in the drawings, the converter with its integral tool caddy may be stored, with the associated suction tools thereon, upon a cooperating wall rack thereby providing a convenient means for storing the tools when not in use.

While preferred embodiments of the present invention have been described and illustrated herein, the invention is not to be limited to the specific embodiments as taught, but may be otherwise embodied within the meaning and scope of the following claims.

We claim:

1. In a floor type vacuum cleaner having a suction fan, a debris receiving chamber, and a suction nozzle whereby debris laden air is drawn into said nozzle, by said suction fan and deposited within said debris receiving chamber, apparatus for converting said vacuum cleaner to an off the floor cleaner comprising:

a) a converter body, for removably and sealingly attaching to said suction nozzle of said vacuum cleaner, b) said body defining a plenum chamber for fluid communication with said suction nozzle, c) inlet connector means extending forward from said converter body for attachment of a suction cleaning accessory thereto such that said accessory is in fluid communication with said plenum chamber, d) accessory support means extending rearward from said converter body for storage of suction cleaning accessories therewith such that said accessories are stored in an unobtrusive manner and do not interfere during cleaning operation.

2. The apparatus as claimed in claim 1 wherein said accessory support means is configured for engaging the inside diameter of a tubular converter associated with a vacuum cleaning tool accessory.

3. The apparatus as claimed in claim 2 wherein said accessory support means comprises at least one support post comprising two intersecting perpendicular blades.

4. The apparatus as claimed in claim 3 wherein said accessory support means includes a multiplicity of said posts.

5. The apparatus as claimed in claim 2 wherein said accessory support means comprises at least one blade having a transverse dimension whereby said suction cleaning accessory is telescopingly received thereon in a friction fit engagement.

6. The apparatus as claimed in claim 2 wherein said accessory support means comprises a multiplicity of intersecting blades.

7. The apparatus as claimed in claim 6 wherein said blades are parallel.

8. The apparatus as claimed in claim 2 wherein said accessory support means comprises three non-perpendicular blades.

9. The apparatus as claimed in claim 8 wherein said blades intersect.

10. The apparatus as claimed in claim 2 wherein said accessory support means comprises a longitudinally extending blade having at least one intersecting transverse projection therefrom.

11. The apparatus as claimed in claim 10 wherein said intersecting projection comprises a semicircular disc.

12. The apparatus as claimed in claim 11 wherein said semicircular disc is perpendicular to said longitudinally extending blade.

13. The apparatus as claimed in claim 1 wherein a flexible suction hose is attached to said inlet connector means.

14. The apparatus as claimed in claim 1 wherein said accessory support means comprises a cylindrical section.

15. The apparatus as claimed in claim 14 wherein said cylindrical section is segmented.

16. A converter apparatus for converting a floor type vacuum cleaner to a suction hose type cleaner wherein said converter comprises:

a) a main body forming a plenum chamber having an inlet and an outlet opening, said inlet opening extending forward from said plenum chamber and including means for attaching thereto a vacuum accessory such that said accessory fluidly communicates with said plenum, b) lip means circumscribing said plenum outlet opening for sealingly engaging the inlet opening of said floor type vacuum cleaner, said lip means including at least one interlocking tang for locking engagement with said vacuum cleaner inlet, c) resilient plenum chamber wall means associated with said interlocking tang whereby application of a force upon said plenum chamber wall means releasably disengages said interlocking tang from said vacuum cleaner inlet, d) at least one accessory support means extending rearwardly from said main body such that said accessories are stored in an unobtrusive manner and do not interfere during cleaning operation.

* * * * *